US012390692B2

(12) United States Patent
Neri

(10) Patent No.: US 12,390,692 B2
(45) Date of Patent: Aug. 19, 2025

(54) TECHNICAL SWIMMING PADDLE FOR ASSISTED STROKE EXECUTION

(71) Applicant: Peter Neri, Paris (FR)

(72) Inventor: Peter Neri, Paris (FR)

(73) Assignee: Peter Neri, Paris (FR)

( * ) Notice: Subject to any disclaimer, the term of this patent is extended or adjusted under 35 U.S.C. 154(b) by 472 days.

(21) Appl. No.: 17/472,640

(22) Filed: Sep. 12, 2021

(65) Prior Publication Data

US 2023/0082921 A1 Mar. 16, 2023

(51) Int. Cl.
*A63B 31/10* (2006.01)

(52) U.S. Cl.
CPC ..... *A63B 31/10* (2013.01)

(58) Field of Classification Search
CPC ..... A63B 31/00; A63B 31/08; A63B 31/10; A63B 31/12; A63B 31/18; A63B 2209/08
USPC ..... 441/55, 56, 58, 59, 62, 64
See application file for complete search history.

(56) References Cited

U.S. PATENT DOCUMENTS

| | | | | |
|---|---|---|---|---|
| 1,541,100 | A | 6/1925 | Barrett | |
| 1,546,670 | A | 7/1925 | O'Sullivan | |
| 1,663,328 | A | 3/1928 | Arnold | |
| 1,708,331 | A | 4/1929 | Ryan | |
| 1,717,026 | A | 6/1929 | Hammett | |
| 2,017,463 | A | 10/1935 | Komadina | |
| 2,389,196 | A | 11/1945 | Harmon | |
| 3,938,207 | A | 2/1976 | Drescher | |
| 3,952,352 | A | 4/1976 | Wan et al. | |
| 4,067,081 | A | 1/1978 | Drescher | |
| 4,316,300 | A | 2/1982 | Lewis | |
| 4,746,313 | A | 5/1988 | Bray et al. | |
| 4,756,699 | A | 7/1988 | Brom | |
| D318,894 | S | 8/1991 | Harling | |
| 5,288,254 | A | 2/1994 | Elson | |
| 5,304,080 | A | 4/1994 | Dilger | |
| 5,376,036 | A | 12/1994 | Hull | |
| 5,643,027 | A | 7/1997 | Evans et al. | |
| 5,647,783 | A | 7/1997 | Nessel | |
| 5,651,710 | A | 7/1997 | Rives et al. | |
| 5,842,896 | A * | 12/1998 | Liveoak | B63H 16/04 441/56 |
| 6,019,650 | A | 2/2000 | Rives et al. | |

(Continued)

FOREIGN PATENT DOCUMENTS

SU 1583115 A1 * 4/1988 ..... A63B 31/08

*Primary Examiner* — Daniel V Venne

(57) ABSTRACT

A technical swimming paddle for guided stroke execution consists of two separate elements that interlock via a longitudinal connecting device. The connecting device admits relative movement and full separation of the two elements when flow pressure is applied to the dorsal surface of the swimmer's hand during incorrect stroke execution, but it locks the two elements into aligned co-planar configuration when flow pressure is applied to the palmar surface of the swimmer's hand during correct stroke execution. The connecting device is designed so that movement and separation of the adjoining components disrupts the swimmer's ability to hold and utilize the technical swimming paddle, therefore discouraging the application of flow pressure to the dorsal surface of the swimmer's hand. In this manner, the technical swimming paddle allows swimmers to fine-tune stroke execution towards optimizing their swimming technique.

1 Claim, 1 Drawing Sheet

(56) References Cited

U.S. PATENT DOCUMENTS

| | | | | |
|---|---|---|---|---|
| 6,899,581 | B1 * | 5/2005 | Nokes | A63B 31/10 441/56 |
| 7,125,299 | B1 * | 10/2006 | Ross, Jr. | A63B 31/04 D21/807 |
| 7,147,526 | B1 | 12/2006 | Chiang | |
| 7,179,146 | B2 | 2/2007 | Johnson | |
| 7,267,595 | B1 | 9/2007 | Hall | |
| 7,494,395 | B2 | 2/2009 | Krikliwy et al. | |
| 7,566,252 | B2 | 7/2009 | Bolster | |
| 8,496,506 | B2 | 7/2013 | Wenzel | |
| 8,585,453 | B2 | 11/2013 | Doyle | |
| D748,752 | S * | 2/2016 | Nokes | D21/807 |
| 9,308,418 | B2 | 4/2016 | Davis et al. | |
| 9,492,712 | B2 | 11/2016 | Smith | |
| D778,380 | S * | 2/2017 | Nokes | D21/807 |
| D789,475 | S | 6/2017 | Abruzzini | |
| 9,717,953 | B1 | 8/2017 | Foss et al. | |
| 9,782,627 | B1 * | 10/2017 | Peterson | A63B 31/10 |
| 9,931,541 | B2 | 4/2018 | Gacek | |
| 10,022,608 | B2 | 7/2018 | Haldeman | |
| 10,080,922 | B2 | 9/2018 | Davis et al. | |
| D837,327 | S | 1/2019 | Stephens et al. | |
| 10,518,135 | B2 | 12/2019 | Evans et al. | |
| 10,549,169 | B2 | 2/2020 | Haldeman, Jr. | |
| D880,635 | S | 4/2020 | Benoit | |
| D890,283 | S | 7/2020 | Abruzzini et al. | |
| 10,894,187 | B2 | 1/2021 | Foss | |

* cited by examiner

TECHNICAL SWIMMING PADDLE FOR ASSISTED STROKE EXECUTION

FIELD OF THE INVENTION

This invention relates to the field of stroke optimization for advanced swimmers. More specifically, it provides real-time feedback for estimating and optimizing flow-pattern efficiency around a swimmer's hand.

BACKGROUND OF THE INVENTION

Typical swimming strokes can be subdivided into five phases: entry, catch, pull, push, and recovery. Although the five phases differ in the prescribed position of a swimmer's hand with respect to surrounding water, they all share one common principle: water flow pressure against the dorsal surface of the swimmer's hand should be consistently minimized. For example, contemporary front-crawl technique, for which the technical swimming paddle is best suited, prescribes that the swimmer's hand should enter the water with minimal resistance and, before progressing on to the catch phase, it should be oriented so that the palm of the swimmer's hand is approximately parallel to the surface of the water. This arrangement ideally envisages minimal flow pressure being applied to either surface (dorsal or palmar) of the swimmer's hand.

The catch phase marks the transition from the configuration of the entry phase onto a configuration where the swimmer's hand is nearly orthogonal to the water surface, setting the stage for an efficient pull phase. During this transition, a primary challenge is to avoid flow pressure against the dorsal surface of the swimmer's hand; this scenario can occur if the catch is initiated prematurely, thus generating drag that works against the forward glide associated with the entry phase.

During both pull and push phases, the swimmer's hand must ideally lock in place and act as pivot by exerting maximal pressure against its palmar surface, moving the swimmer forward by swiveling the swimmer's arm around the swimmer's hand. Except for the inevitable pressure that may be exerted by turbulence on the dorsal surface of the swimmer's hand, all forces applied to the dorsal surface of the swimmer's hand should be minimized to avoid displacing the swimmer's hand in the direction opposite to that intended by the swimmer.

The final phase involves recovery to the entry phase. Similar to the catch phase, the recovery phase involves a delicate transition during which the swimmer's hand is disengaged from pushing against its palmar surface and is brought back into forward gliding configuration, ready for entry. If enacted prematurely, recovery causes water to exert pressure on the dorsal surface of the swimmer's hand. The resulting drag not only slows down forward propulsion, but also serves to destabilize correct re-orientation of the swimmer's hand.

When looking to improve their technique, swimmers consistently attempt to monitor the water flow pattern surrounding their body (including their hands), either implicitly or explicitly. However, water flow surrounding the swimmer's hands and body is exceedingly difficult to monitor accurately via somatosensory perception, as a consequence of the saturating stimulation produced on the swimmer's skin by the swimming action. As for monitoring absolute hand orientation per se (e.g. in relation to water surface orientation), this is challenging to achieve in the absence of stable visual cues (for example when executing front crawl), and proprioception is prohibitively poor when floating in water. For these reasons, swimmers can greatly benefit from devices that provide them with real-time feedback on correct placement/dynamics of their hands throughout the stroke cycle. The present invention is intended for such purpose, while at the same time retaining mechanical simplicity without involvement of sophisticated measuring components (e.g. accelerometers).

Previous patents aimed at aiding swimmers in stroke execution using hand paddles have rarely incorporated moving elements of any kind. The large majority of swimming hand paddles is designed around the principle of shaping a single rigid element so that it either reduces or enhances drag around the swimmer's hand as a function of stroke mechanics (e.g. U.S. Pat. No. 7,179,146 B2, U.S. Pat. No. D837,327 S, U.S. Pat. No. 10,894,187 B2, U.S. Pat. No. D880,635 S, U.S. Pat. No. 10,549,169 B2, U.S. Pat. No. 10,518,135 B2, U.S. Pat. No. 10,022,608 B2, U.S. Pat. No. 9,931,541 B2, U.S. Pat. No. 9,717,953 B1, U.S. Pat. No. 8,496,506 B2, U.S. Pat. No. 7,566,252 B2, U.S. Pat. No. 7,494,395 B2, U.S. Pat. No. 7,147,526 B1, U.S. Pat. No. 7,125,299 B1, U.S. Pat. Nos. 6,019,650, 5,651,710, 5,376,036, U.S. Pat. No. Des. 318,894, U.S. Pat. Nos. 5,288,254, 9,308,418 B2, 1,546,670, 1,717,026). Because in the above disclosures the swimming aid takes on a rigid shape, it does not dynamically respond to water flow by modifying its configuration. As such, it is incapable of providing a targeted estimate of water flow pattern around the swimmer's hand that is conveyed to swimmers via obvious configural changes. Furthermore, with a few exceptions (U.S. Pat. No. 5,288,254), those inventions are generally designed to aid swimmers in the execution of only the pull and push phases, namely that portion of the stroke cycle during which the swimmer's hand is oriented perpendicularly to the direction of movement and is used to propel the swimmer forward.

Other relevant technical swimming aids have occasionally incorporated moving elements, but of an entirely different nature and/or with unrelated objectives. The moving flap attached to the hand paddle disclosed in U.S. Pat. No. 8,585,453 B2, for example, is designed to produce additional drag during the pull phase when the swimmer executes this movement incorrectly. Although this device shares some objectives with the present invention, it differs substantially both in design and in its capability to respond to the flow pattern around the swimmer's hand: to mention one difference, it does not respond to pressure applied to the dorsal surface of the swimmer's hand. Furthermore, it does not provide direct feedback to the swimmer, but rather indirectly via increased drag.

A different approach has been to maintain rigidity of the paddle, yet enhance its monitoring capabilities via electronic sensors that measure parameters such as orientation and acceleration of the swimmer's hand (e.g. U.S. Pat. Nos. 10,080,922 B2, 3,952,352). Electronic sensors are costly, involve data storage and digital processing, and are not designed to specifically monitor water flow. Because the relationship between the parameters relayed by electronic sensors and water flow pattern around the swimmer's hand is of an indirect nature, this approach does not provide effective monitoring of water flow pattern around the swimmer's hand.

There is an additional class of devices that, upon cursory inspection, may appear related to the present invention: hinged paddles (e.g. U.S. Pat. Nos. 2,017,463, 2,389,196, 5,647,783, 5,304,080, SU Pat. No. 1583115 A1). The critical difference between those devices and the present invention is that, in the case of previous devices, the hinged section is designed to serve a useful purpose, rather than a potentially disruptive role under incorrect stroke execution (as is the case for the present invention). Consider for example U.S. Pat. No. 1,541,100 (see also U.S. Pat. Nos. 5,304,080, 2,389,196 for related examples): this hand paddle is designed so that it can bend around a hinge oriented orthogonally to the direction of movement, and in so doing assumes a concave shape analogous to the configuration that may be obtained with flexible hand paddles (e.g. U.S. Pat. No. 6,899,581 B1, U.S. Pat. Nos. 4,746,313, 4,067,081, 3,938,207). In these designs, the hinge is intended as a flexible element that should be exploited by swimmers to aid their efficiency. Similarly, U.S. Pat. No. 2,017,463 presents two lateral flaps that only fold when flow pressure is applied to the dorsal surface of the swimmer's hand, and not to its palmar surface, similar to the present invention (see also U.S. Pat. Nos. 4,756,699 and 4,316,300 for related designs attached to the forearm). In U.S. Pat. No. 2,017,463, however, the folding elements are intended for positive exploitation by the swimmer in order to carry the hand paddle back to its starting position before executing another pull: they are designed to reduce resistance of hand movement through water during the recovery phase of the stroke cycle. Furthermore, the principles behind U.S. Pat. No. 2,017,463 are only applicable in the restricted case of non-technical swimming style, in which the recovery phase is performed by simply executing the pull phase in reverse fashion. This approach is never utilized during technical swimming in conformity with contemporary practice (as described above). Similar considerations apply to U.S. Pat. Nos. 1,663,328, 1,708,331, and SU Pat. No. 1583115 A1.

OBJECTS OF THE INVENTION

The objective of the present invention is to equip swimmers with a technical swimming paddle that, when used incorrectly, readily changes configuration so as to become ineffective/unusable, and does so in a manner that is immediately obvious to swimmers. This real-time feedback can then be exploited by swimmers to adjust their stroke execution in an effort to maintain the technical swimming paddle in its stable configuration, a process that aligns with correct swimming technique. More specifically, whenever water flow pressure is applied to the dorsal surface of the technical swimming paddle, the technical swimming paddle separates into two elements and loses its functionality. On the contrary, when water pressure is applied to the palmar surface of the technical swimming paddle, the technical swimming paddle retains its flat rigid shape and therefore maintains its functionality. During correct execution of the stroke cycle, pressure should only be applied to the palmar surface of the technical swimming paddle; under this scenario, swimmers would experience the present invention as no different than regular rigid hand paddles. During incorrect execution, however, movement of the swimmer's hand almost invariably results in substantial pressure being applied to the dorsal surface of the technical swimming paddle; under this scenario, swimmers are made immediately aware of the incorrect nature of their stroke technique by the evident loss of paddle functionality.

Other objects and advantages of the invention will in part be obvious and will in part be apparent from the specification and drawings.

SUMMARY OF THE INVENTION

A technical swimming paddle comprises: one left plate, the left plate being a planar or nearly planar element of trapezoidal or rectangular shape with rounded edges; one right plate, the right plate being a planar or nearly planar element of trapezoidal or rectangular shape with rounded edges, not necessarily identical to the left plate; a connecting device that, when engaged, allows the left plate to interlock with the right plate so that the two plates remain interlocked and co-planar when flow pressure is applied from one side of the plates in the direction perpendicular to the orientation of the plates, the connecting device allowing the two plates to disengage from the interlocked configuration and become fully disconnected when flow pressure is applied from the opposite side; a holding device that is integral to the connecting device, the holding device allowing swimmers to hold the technical swimming paddle by placing their fingers around the holding device, the holding device retaining its function of allowing swimmers to hold the technical swimming paddle when the connecting device is engaged so that the two plates are interlocked, the holding device losing its function of allowing swimmers to hold the technical swimming paddle when the connecting device is disengaged and the two plates are disconnected.

It is a general objective of the present invention to provide swimmers with a hand paddle for strength training that also prevents improper technique by changing configuration under the effect of flow patterns that are inconsistent with correct technical execution.

It is more particularly an objective of the present invention to provide swimmers with immediate feedback regarding the occurrence of incorrect stroke execution, so that swimmers can adjust stroke execution in real time.

Yet another particular objective of this invention is to achieve the above-stated goals via simple mechanical means that can be easily incorporated into a cost-effective design that is also robust and durable.

A further objective of this invention is to achieve the above-stated goals by means of an appealing design that is not too dissimilar in appearance from regular paddles, so that swimmers are not discouraged from utilizing it by cumbersome design or appearance that attracts unwanted attention.

Other objectives, features and advantages of the present invention will be apparent from the drawings and detailed description below.

BRIEF DESCRIPTION OF DRAWINGS

Referenced features of disclosed invention are illustrated in FIGS. 1, 2, and 3.

FIG. 2 illustrates the basic principle behind the technical swimming paddle (for left hand only) viewed from the top side (top of FIG. 2) and from the front side (bottom of FIG. 2), with the two halves of the paddle (the right half in white color, the left half in gray color) interlocked via the connecting device.

FIG. 1 illustrates the right half of the paddle, while FIG. 3 illustrates the left half of the paddle, viewed from four different sides (top, left, right, front).

DETAILED DESCRIPTION OF THE PREFERRED EMBODIMENTS

Figures 1, 2, 3:
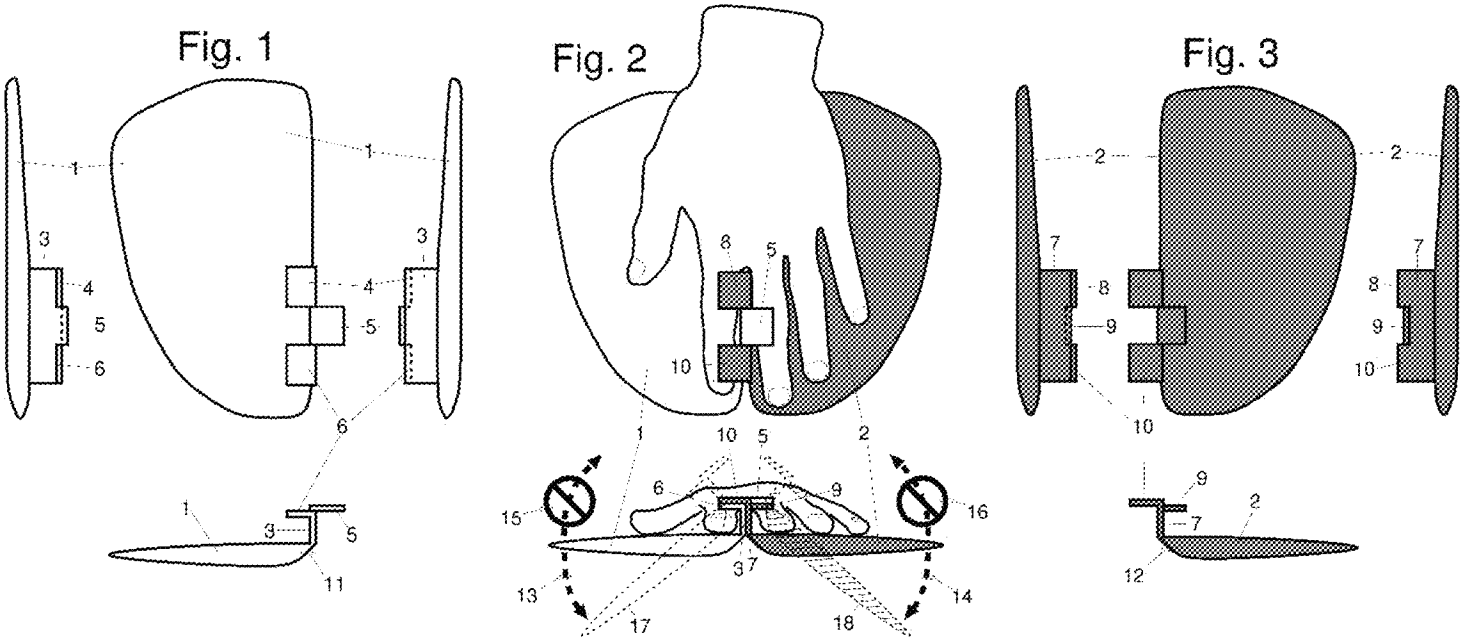

The technical swimming paddle under disclosure is intended for use by a swimmer, the swimmer being the individual who is performing, or attempting to perform, a swimming action in compliance with contemporary swimming technique. We refer to the left hand of the swimmer as a swimmer's hand.

The design principle underlying the technical swimming paddle under disclosure is summarized in FIG. 1-3. We refer to the six different sides of the technical swimming paddle with reference to the swimmer's hand applied to the technical swimming paddle in the manner demonstrated in FIG. 2, the swimmer's hand extended forward with its palmar surface facing the ground: a front side is the side towards which a swimmer's fingers, namely the fingers of the swimmer's hand, point; a back side is the side opposite to the front side; a bottom side is the side located under the palmar surface of the swimmer's hand; a top side is the side opposite to the bottom side; a right side is the side towards the thumb of the swimmer's hand (left part of FIG. 2); a left side (right part of FIG. 2) is the side opposite to the right side.

A palmar surface of the technical swimming paddle or its components is defined as the surface of the technical swimming paddle or its components facing the bottom side. A dorsal surface of the technical swimming paddle or its components is defined as the surface of the technical swimming paddle or its components facing the top side. A leftward-facing surface of a given component is the surface of that component facing towards the left side. A rightward-facing surface of a given component is the surface of that component facing towards the right side. An upward-facing surface of a given component is the surface of that component facing towards the top side. A downward-facing surface of a given component is the surface of that component facing towards the bottom side.

We define a longitudinal direction of the technical swimming paddle with reference to the swimmer's hand applied to the technical swimming paddle in the manner demonstrated in FIG. 2, as the direction extending from the crease of the wrist of the swimmer's hand to the tip of the middle finger of the swimmer's hand. A left-right direction of the technical swimming paddle is the direction extending from the left side to the right side. A lateral extent of a given component is the spatial extent of that component along the left-right direction.

When a given component extends leftward, the given component extends from its point of attachment to the technical swimming paddle towards the left side. When a given component extends rightward, the given component extends from its point of attachment to the technical swimming paddle towards the right side. When a given component extends upward, the given component extends from its point of attachment to the technical swimming paddle towards the top side.

When a given component is lower-offset with respect to other component(s), the given component is out of alignment with the other component(s) as a consequence of being shifted towards the bottom side. When a given component is upper-offset with respect to other component(s), the given component is out of alignment with the other component(s) as a consequence of being shifted towards the top side.

We refer to different views of the present invention or its components with reference to the side from which the invention or its components are viewed: top view is a view of the invention or its components from the top side, front view is a view of the invention or its components from the front side. Following this convention, the top part of FIG. 2 depicts a top view of the invention with the swimmer's hand placed as intended, while the bottom part of FIG. 2 depicts the corresponding front view.

A technical swimming paddle is divided along its longitudinal direction into two separate elements: a right half of the technical swimming paddle (shown in FIG. 1), and a left half of the technical swimming paddle (shown in FIG. 3). In FIG. 1-3, all components belonging to the right half of the technical swimming paddle (1,3,4,5,6) are shown in white color, while all components belonging to the left half of the technical swimming paddle (2,7,8,9,10) are shown in gray color.

The right half of the technical swimming paddle (FIG. 1) consists of a right plate (1), a right ridge (3), two right protrusions extending rightward (4,6), and one right protrusion extending leftward (5). We refer collectively to the two right protrusions extending rightward (4,6) and to the right protrusion extending leftward (5) as right protrusions (4,5,6).

The right plate (1) is oriented parallel to the swimmer's hand (as demonstrated in FIG. 2). A suitable choice of dimensions for the right plate (1) would be 15.0 cm×10.0 cm×0.5 cm (length×width×thickness), however it is envisaged that slightly different values may serve equally well. The right plate (1) may be shaped in the fashion of a trapezoid with rounded edges, however it is envisaged that other shapes may serve equally well provided they do not depart excessively from the area occupied by the swimmer's hand.

The right ridge (3) is rectangular in shape and extends upward from the right plate (1), such that the primary face of the right ridge (3) is orthogonal to the right plate (1) and the main axis of the right ridge (3) is oriented along the longitudinal direction (FIG. 1). A suitable choice of dimensions for the right ridge (3) would be 7.5 cm×2.5 cm×0.3 cm (length×height×thickness), however it is envisaged that slightly different values may serve equally well.

The two right protrusions extending rightward (4,6) are rectangular in shape and extend rightward from the top side of the right ridge (3), with their largest surface parallel to the right plate (1), as illustrated in FIG. 1. A suitable choice of dimensions for the two right protrusions extending rightward (4,6) would be 2.5 cm×2.0 cm×0.3 cm (length×width×thickness), however it is envisaged that slightly different values may serve equally well.

A third right protrusion extending leftward (5) is rectangular in shape and extends leftward from the top side of the right ridge (3), with its largest surface parallel to the right plate (1), as illustrated in FIG. 1. A suitable choice of dimensions for the right protrusion extending leftward (5) would be 2.5 cm×2.3 cm×0.3 cm (length×width×thickness), however it is envisaged that slightly different values may serve equally well, provided they are such that the lateral extent of the right protrusion extending leftward (5) exceeds the lateral extent of the right protrusions extending rightward (4,6) by an amount approximately equal to the thickness of the right ridge (3). Furthermore, the right protrusion extending leftward (5) is upper-offset with respect to the two right protrusions extending rightward (4,6) along the height of the right ridge (3), as illustrated in FIG. 1. The size of the upper offset is approximately equal to the thickness of the right protrusions (4,5,6), which is best specified to be approximately equal for all right protrusions.

The left half of the technical swimming paddle (FIG. 3) is similar in structure and size to the right half of the technical swimming paddle detailed above (FIG. 1). It consists of a left plate (2), a left ridge (7), two left protrusions extending rightward (8,10), and one left protrusion extending leftward (9). We refer collectively to the two left protrusions extending rightward (8,10) and to the left protrusion extending leftward (9) as left protrusions (8,9,10).

The left plate (2) is oriented parallel to the swimmer's hand (as demonstrated in FIG. 2), with dimensions similar to those specified for the right plate (1).

A left ridge (7), similar in size and shape to the right ridge (3), extends from the left plate (2), such that the primary face of the left ridge (7) is orthogonal to the left plate (2) and the main axis of the left ridge (7) is oriented along the longitudinal direction (FIG. 3).

The two left protrusions extending rightward (8,10) are rectangular in shape and extend rightward from the top side of the left ridge (7), with their largest surface parallel to the left plate (2), as illustrated in FIG. 3. A suitable choice of dimensions for the two left protrusions extending rightward (8,10) would be 2.5 cm×2.3 cm×0.3 cm (length×width×thickness), however it is envisaged that slightly different values may serve equally well.

The left protrusion extending leftward (9) is rectangular in shape and extends leftward from the top side of the left ridge (7), with its largest surface parallel to the left plate (2), as illustrated in FIG. 3. A suitable choice of dimensions for the left protrusion extending leftward (9) would be 2.5 cm×2.0 cm×0.3 cm (length×width×thickness), however it is envisaged that slightly different values may serve equally well. The left protrusion extending leftward (9) is lower-offset with respect to the two left protrusions extending rightward (8,10) along the height of the left ridge (7), as illustrated in FIG. 3. The size of this lower offset is approximately equal to the thickness of the left protrusions (8,9,10), which is best specified to be approximately equal for all left protrusions, and should be approximately equal to the thickness of the right protrusions (4,5,6) extending from the right ridge (3).

The two plates (1,2) are not necessarily of exactly equal size or shape, and not necessarily exactly planar. They are depicted as symmetric and planar in FIG. 1-3, but neither perfect symmetry nor perfect planarity of the plates are necessary features of the invention.

A connecting device consists of the following elements: the right ridge (3), the right protrusions (4,5,6), the left ridge (7), and the left protrusions (8,9,10). A right half of the connecting device consists of the following elements: the right ridge (3) and the right protrusions (4,5,6). A left half of the connecting device consists of the following elements: the left ridge (7) and the left protrusions (8,9,10).

A holding device consists of the following elements: the right plate (1), the right ridge (3), the two right protrusions extending rightward (4,6), the left plate (2), the left ridge (7), and the left protrusion extending leftward (9).

Left half and right half of the technical swimming paddle can be interlocked via the connecting device to assume the shape of a regular swimming hand paddle (FIG. 2). In this interlocked configuration (illustrated in FIG. 2), the leftward-facing surface of the right ridge (3) comes into contact with the rightward-facing surface of the right ridge (7), the downward-facing surface of the right protrusion extending leftward (5) comes into contact with the upward-facing surface of the left protrusion extending leftward (9), and the downward-facing surfaces of the two left protrusions extending rightward (8,10) come into contact with the upward-facing surfaces of the two right protrusions extending rightward (4,6). More specifically, the downward-facing surface of the left protrusion extending rightward located towards the back side of the technical swimming paddle (8) comes into contact with the upward-facing surface of the right protrusion extending rightward located towards the back side of the technical swimming paddle (4), while the downward-facing surface of the left protrusion extending rightward located towards the front side of the technical swimming paddle (10) comes into contact with the upward-facing surface of the right protrusion extending rightward located towards the front side of the technical swimming paddle (6).

When the connecting device is not in the interlocked configuration detailed above, the technical swimming paddle is said to be in disengaged configuration. When the technical swimming paddle is in its disengaged configuration, the left half of the technical swimming paddle becomes separated from the right half of the technical swimming paddle. This configuration is illustrated by the dashed elements (17,18) in FIG. 2.

When the connecting device is in interlocked configuration, the technical swimming paddle is similarly said to be in interlocked configuration. When the technical swimming paddle is in interlocked configuration, the swimmer's hand can hold the technical swimming paddle by placing the left index finger of the swimmer's hand under the two right protrusions extending rightward (4,6) and the left middle finger of the swimmer's hand under the right protrusion extending leftward (9), as illustrated in FIG. 2. Under this configuration, the swimmer can utilize the technical swimming paddle as a regular swimming hand paddle.

When the technical swimming paddle is in disengaged configuration, the paddle and the holding device are similarly said to be in disengaged configuration. When the holding device is in disengaged configuration, the swimmer's hand can no longer hold the technical swimming paddle, because the left half of the technical swimming paddle is separated from the right half of the technical swimming paddle. Under this configuration, the swimmer cannot utilize the technical swimming paddle as a regular swimming hand paddle.

When flow pressure is applied to the palmar surface of the technical swimming paddle in interlocked configuration, which occurs when the swimmer correctly performs the swimming action, the technical swimming paddle remains in interlocked configuration because left half and right half of the technical swimming paddle are prevented from folding towards the top side of the technical swimming paddle by the connecting device. In FIG. 2, this prohibited folding action is depicted by two dashed arrows accompanied by two signs indicating that the action is not allowed (15,16).

When flow pressure is applied to the dorsal surface of the technical swimming paddle in interlocked configuration, which occurs when the swimmer incorrectly performs the swimming action, the technical swimming paddle assumes a disengaged configuration because left half and right half of the technical swimming paddle are permitted to fold towards the bottom side of the technical swimming paddle by the connecting device. In FIG. 2, this permitted folding action is depicted by two dashed arrows (13,14), and the configuration assumed by the left half and the right half of the technical swimming paddle under this folding action is indicated by dashed elements (17,18).

In the embodiment depicted in FIG. 1-3, the edge of the right plate immediately under the right ridge (11) and the edge of the left plate immediately under the left ridge (12) present a slanted profile running along the longitudinal direction. This feature is introduced to facilitate folding of left and right plates (17,18) during incorrect stroke execution, but it is not critical to the proposed design.

When flow pressure is applied to the dorsal surface of the technical swimming paddle as described above, left half and right half of the technical swimming paddle may not fully separate from each other in the process of folding, because some components of the right half of the connecting device (3,4,5,6) may remain in partial contact with some components of the left half of the connecting device (7,8,9,10). The extent of the separation will depend on the extent of departure from correct swimming technique.

Whether the separation between the left half of the technical swimming paddle and the right half of the technical swimming paddle is full or partial when the technical swimming paddle is in disengaged configuration, it is intended that this configural change from interlocked configuration to disengaged configuration should be disruptive to the swimmer, and it is therefore intended that this configural change should be actively avoided by the swimmer, thus prompting the swimmer to maintain correct swimming technique. This specific characteristic sets the present invention apart from related inventions containing hinges (U.S. Pat. Nos. 2,017,463, 2,389,196, 5,647,783, 5,304,080, 1,663,328, 1,708,331, 1,541,100, SU Pat. No. 1583115 A1).

The above detailed interlocking design, or variations upon it that retain the same function in their essence and purpose, can be readily augmented by the addition of simple and cost-effective components, such as magnetic elements, that allow swimmers to vary the amount of water pressure required for the technical swimming paddle to assume a disengaged configuration.

The above detailed disclosure is intended as only illustrative of the preferred embodiment of, and not a limitation upon the scope of, the disclosed invention. Those skilled in the art will envision many other possible variations of the structure disclosed herein that nevertheless fall within the scope of the following claims. For example, it is conceivable that the left and right plates may be shaped in a slightly different manner than detailed above for the purpose of optimizing efficiency or incorporating ergonomic principles (U.S. Pat. Nos. 7,267,595 B1 and 5,643,027, U.S. Pat. No. D789,475 S, U.S. Pat. No. 9,492,712 B2, U.S. Pat. No. D890,283 S). It is also conceivable that straps or clips may be introduced to bind one or more fingers, or other parts of the swimmer's hand and/or wrist, to the technical swimming paddle. These may be either flexible or essentially rigid. It is also envisaged that one or both plates (1,2) may be modified with the addition of perforated sections as is commonly observed in swimming paddle designs (e.g. U.S. Pat. Nos. 9,931,541 B2, 9,492,712 B2, 7,179,146 B2, 7,147,526 B1, 6,019,650, 5,651,710). Accordingly, the scope of the invention should be determined with reference to the appended claims, and not by the examples given above.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A technical swimming paddle comprising:

a. two separate plates, a left plate and a right plate, each plate having a dorsal surface and a palmar surface essentially parallel with each other, the dorsal surface of the plates being defined as the surface upon which the palmar surface of a swimmer's hand is placed when using the technical swimming paddle, the palmar surface of the plates being defined as the surface opposite to the dorsal surface of the plates;

b. a connecting device consisting of two elements, a left half of the connecting device and a right half of the connecting device, the left half of the connecting device being attached to the left plate and the right half of the connecting device being attached to the right plate, the two halves of the connecting device featuring protrusions that allow the two halves of the connecting device to interlock along the longitudinal direction of the technical swimming paddle, the connecting device functioning to maintain the two plates in co-planar and interlocked configuration when flow pressure applied to the palmar surface of the plates is greater than flow pressure applied to the dorsal surface of the plates, the connecting device allowing the two plates to disengage from the interlocked configuration and fully separate from each other when flow pressure applied to the dorsal surface of the plates is greater than flow pressure applied to the palmar surface of the plates;

c. a holding device integrated into the connecting device and consisting of two halves, a left half of the holding device and a right half of the holding device, the left half of the holding device being integrated into the left half of the connecting device and the right half of the holding device being integrated into the right half of the connecting device, the holding device allowing a swimmer's fingers to hold the two plates while resting the palmar surface of the swimmer's hand on the dorsal surface of the plates when the two plates are interlocked via the connecting device, the holding device not allowing the swimmer's fingers to hold the two plates when the two plates disengage from the interlocked configuration and separate from each other.

* * * * *